US005232805A

United States Patent [19]

Misawa et al.

[11] Patent Number: 5,232,805

[45] Date of Patent: Aug. 3, 1993

[54] MAGNETIC PARTICLES CONTAINING IRON AS THE MAIN COMPONENT AND PROCESS FOR PRODUCING THE SAME

[75] Inventors: Hiromitsu Misawa; Kazuo Fujioka; Eiichi Kurita, all of Hiroshima; Yasuhiko Fujii, Otake; Youzi Okano, Higashi-Hiroshima, all of Japan

[73] Assignee: Toda Kogyo Corporation, Hiroshima, Japan

[21] Appl. No.: 645,880

[22] Filed: Jan. 24, 1991

[30] Foreign Application Priority Data

Jan. 26, 1990 [JP] Japan ..... 2-17423

[51] Int. Cl.[5] ..... G03G 9/14

[52] U.S. Cl. ..... 430/106.6; 430/122; 430/903; 252/62.56

[58] Field of Search ..... 430/106.6, 122, 129, 430/903; 252/62.56

[56] References Cited

U.S. PATENT DOCUMENTS

| | | | |
|---|---|---|---|
| 4,450,221 | 5/1984 | Terada et al. | 430/106.6 |
| 4,935,325 | 1/1990 | Kuribayoshi et al. | 430/106.6 |
| 4,960,666 | 10/1990 | Weagley et al. | 430/109 |
| 5,066,558 | 11/1991 | Hikake et al. | 430/109 |

OTHER PUBLICATIONS

Patent Abstracts of Japan, vol. 9, No. 182 (P-376) [1905].

Patent Abstracts of Japan, vol. 11, No. 270 (P-611) [2717].

Patent Abstracts of Japan, vol. 4, No. 58 (P-9) [540].

Patent Abstracts of Japan, vol. 5, No. 165 (P-85) [837].

*Primary Examiner*—Marion E. McCamish

*Assistant Examiner*—S. Rosasco

*Attorney, Agent, or Firm*—Nixon & Vanderhye

[57] ABSTRACT

Disclosed herein is magnetic particles containing iron as the main component which have an average particle diameter of 0.1 to 3.0 μm and a liquid absorption of not more than 18 m∞.

20 Claims, No Drawings

MAGNETIC PARTICLES CONTAINING IRON AS THE MAIN COMPONENT AND PROCESS FOR PRODUCING THE SAME

BACKGROUND OF THE INVENTION

The present invention relates to magnetic particles containing iron as the main component and, more particularly, to magnetic particles which have a good affinity for a vinyl aromatic resin, an acrylic resin and a copolymer of monomers thereof generally used for a magnetic toner, and an excellent mixing property with these resins for a magnetic toner, and process for producing the same.

A developing method using composite particles obtained by dispersing magnetic particles such as magnetite particles into a resin as a developer without using a carrier, which are generally called a one-component type magnetic toner, is conventionally known and used as one of a method of developing an electrostatic latent image.

With the recent development of copying machines having a higher performance such as a capability of continuously copying a higher-quality image at a higher speed, and magnetic toner as a developer is strongly required to improve the properties and for this purpose, magnetic particles which have an excellent mixing property with a magnetic toner resin are strongly demanded.

This fact is described in Japanese Patent Application Laid-Open (KOKAI) No. 55-65406 (1980) as "Generally, magnetic particles for a magnetic toner of such as one-component type are required to have the following properties. . . . VII) To have an excellent mixing property with a resin. Ordinarily, the particle diameter of a toner is not more than several ten μm, and the microscopic degree of mixing in the toner is an important property of the toner. . . . ".

Magnetite particles having an isotropic shape such as an octahedron and a sphere are mainly used as magnetic particles for a magnetic toner, which are added to a vinyl aromatic resin such as styrene resin and vinyl toluene resin, an acrylic resin such as acrylic acid resin and a methacrylic acid resin, and a copolymer of these monomers thereof, which are used as resins for a magnetic toner.

Magnetic particles which have an excellent of mixing property with a resin are in the strongest demand at present, but known magnetic particles have a poor affinity for a resin. No magnetic particles which have an excellent mixing property with a resin has been provided yet.

The affinity of particles for a resin in the present invention means the degree of the affinity of the surfaces of magnetic particle for a resin.

As an index of the dispersibility of magnetic particles in a resin, the gloss of the surfaces of a resin molding containing the magnetic particles is generally measured, and as the value is higher, the dispersibility is regarded as better.

When the present inventor measured the gloss of a resin molding made of known magnetic particles at an incident angle of 60°, most of them were not less than 90%, but when the incident angle was lowered to 20° so as to sense minute projections and dents on the surfaces of the resin molding, the gloss of all the resin molding were reduced to not more than 90%.

The present inventor presumed that this phenomenon was caused because the known magnetic particles were present in the resin in the form of agglomerates due to the poor affinity of each particle for the resin, and that if each particle has a superior affinity for the resin, the magnetic particles have an excellent mixing property with the resin so that they are uniformly dispersed in the resin, resulting in a smooth surface of the resin molding, thereby obtaining not less than 90% of gloss even at an incident angle of 20°.

That is, it is considered that the gloss measured at an incident angle of 20° is an index of the affinity for a resin and the magnetic particles in a resin molding the surface of which has a gloss of not less than 90% are particles having a good affinity for a resin.

As a result of studies undertaken by the present inventors so as to obtain magnetic particles having a good affinity for a resin, it has been found that by kneading, smearing and spatula-stroking magnetic particles containing iron as the main component which have an average particle diameter of 0.1 to 3.0 μm by means of a wheel-type mill or an attrition mill so as to release from an agglomeration thereof, the obtained magnetic particles containing iron as the main component have an average particle diameter of 0.1 to 3.0 μm and a liquid absorption of not more than 18 ml, and a gloss of the surface of a resin molding containing such magnetic particles is not less than 90% when measured at an incident angle of 20°: The present invention has been achieved on the basis of this finding.

SUMMARY OF THE INVENTION

In a first aspect of the present invention, there are provided magnetic particles containing iron as the main component and having an average particle diameter of 0.1 to 3.0 μm and a liquid absorption of not more than 18 ml as measured in the following method:

A styrene-acrylic resin and xylene are mixed at a resin content: (resin)/(resin+xylene)×100 of 20 wt %, in a polyester container provided with a cover by using a paint conditioner, thereby obtaining a resin solution.

10 g of a magnetic particles containing iron as the main component which are weighed out by an electronic balance are charged in a 100-ml polyester container, to which 50 ml of the said resin solution prepared are added dropwise in the container by using a burette and the resultant mixture is stirred with a glass rod.

The obtained paste in the polyester container becomes uniform and when the fluidity thereof is increased until a first droplet naturally drops from the end of the glass rod, this point is regarded as the end point.

The amount of the resin solution used until the end point is measured as the liquid absorption.

In a second aspect of the present invention, there is provided magnetic particles containing iron as the main component which have an isotropic shape, an average particle diameter of 0.1 to 1.0 μm and a liquid absorption of not more than 10 ml as measured in the defined method in the first aspect, and are coated with an organic compound having a hydrophobic group.

In a third aspect of the present invention, there is provided magnetic particles containing iron as the main component which have an acicular or spindle shape, an average major axial diameter of 0.1 to 3.0 μm, an axial ratio (major axial diameter/minor axial diameter) of not more than 3 and a liquid absorption of not more than 18 ml as measured in the defined method in the first aspect.

In a fourth aspect of the present invention, there is provided magnetic particles containing iron as the main component which have an acicular or spindle shape, an average major axial diameter of 0.1 to 3.0 μm, an axial ratio (major axial diameter/minor axial diameter) of not more than 10 and a liquid absorption of not more than 18 m as measured in the defined method in the first aspect, and are coated with an organic compound having a hydrophobic group.

In a fifth aspect of the present invention, there is provided a process for producing magnetic particles defined in the first aspect, which comprises kneading, smearing and spatule-stroking magnetic particles containing iron as the main component which have an average particle diameter of 0.1 to 3.0 μm by means of a wheel-type mill or an attrition mill so as to release from an agglomeration thereof.

In a sixth aspect of the present invention, there is provided a magnetic toner comprising the magnetic particles defined as the first aspect and a vinyl aromatic resin, an acrylic resin or a copolymer of monomers thereof.

DETAILED DESCRIPTION OF THE INVENTION

Magnetic particles having a good affinity for a resin, namely, magnetic particles in which a gloss measured at an incident angle of 20° to the surface of a resin molding is not less than 90% when the magnetic particles are incorporated into a resin, have a liquid absorption of not more than 18 ml as measured in the following method:

A styrene-acrylic resin and xylene are mixed at a resin content: (resin)/(resin+xylene)×100 of 20 wt %, in a polyester container provided with a cover by using a paint conditioner, thereby obtaining a resin solution.

10 g of a magnetic particles containing iron as the main component which are weighed out by an electronic balance are charged in a 100-ml polyester container, to which 50 ml of the said resin solution prepared are added dropwise in the container by using a burette and the resultant mixture is stirred with a glass rod.

The obtained paste in the polyester container becomes uniform and when the fluidity thereof is increased until a first droplet naturally drops from the end of the glass rod, this point is regarded as the end point.

The amount of the resin solution used until the end point is measured as the liquid absorption.

The reason why a styrene-acrylic resin is used as a resin in the measurement of the liquid absorption is that the styrene-acrylic resin is a typical resin which is used widely as a resin for a magnetic toner. Xylene is used as the solvent because since xylene does not have a strong functional group, xylene acts on a resin so as to dilute the resin in preference to the magnetic particles, which is effective for observing the influence of the resin on the surfaces of the magnetic particles. In addition, since xylene has a high boiling point such as about 130° C., it is unlikely to evaporate during operation.

The preferable magnetic particles of the present invention are classified as follows.

(1) Magnetic particles containing iron as the main component have an isotropic shape, an average particle diameter of 0.1 to 1.0 μm, preferably 0.1 to 0.5 μm and a liquid absorption of not more than 10 ml as measured in the above-defined method, and are coated with an organic compound having a hydrophobic group.

(2) Magnetic particles containing iron as the main component have an acicular or spindle shape, an average major axial diameter of 0.1 to 3.0 μm, preferably 0.1 to 1.0 μm, an axial ratio (major axial diameter/minor axial diameter) of not more than 3, preferably 1.5 to 2.5 and a liquid absorption of not more than 18 ml, preferably not more than 14 ml as measured in the above-defined method.

(3) Magnetic particles containing iron as the main component have an acicular or spindle shape, an average major axial diameter of 0.1 to 3.0 μm, preferably 0.1 to 1.0 μm, an axial ratio (major axial diameter/minor axial diameter) of not more than 10, preferably not more than 8, more preferably 1.5 to 7.0 and a liquid absorption of not more than 18 ml , preferably not more than 16 ml , as measured in the above-defined method, and are coated with an organic compound having a hydropholic group.

The reason why the liquid absorption of the magnetic particles (1) and (3) according to the present invention is small is considered to be that when a wheel-type mill or an attrition mill is used, the kneading operation presses the organic compound having a hydrophobic group existent between the magnetic particles to the surfaces of the magnetic particles and spreads the organic compound through the gaps between the particles so as to bring the organic compound into close-contact with the particle surfaces, the smearing operation changes the positions of the particle groups so as to separate the agglomerated particles in a discrete state while spreading the organic compound having a hydrophobic group, the spatula-stroking operation uniformly spreads the organic compound having a hydrophobic group which is existent on the surfaces of the particles with a spatula, and the repetition of these three operations release from the agglomeration of the magnetic particles without reagglomeration and makes the surface of each particle highly hydrophobic.

The reason why the liquid absorption of magnetic particles (2) according to the present invention is small is considered to be that air and gas existent between the magnetic particles is deaired and degased so as to separate the agglomerated particles in a discrete state, namely, that when a wheel-type mill or an attrition mill is used, the kneading operation presses the magnetic particles each other so as to remove air and gas existent between the magnetic particles, thereby obtaining a high close-contact between the magnetic particles, the smearing operation changes the positions of the particles group so as to separate the agglomerated particles in a discrete state, the spatula-stroking operation uniformly penetrates the particles with the kneading operation and smearing operation, thereby separating the particles in a discrete state, and the repetition of these three operations release from the agglomeration of the magnetic particles without re-agglomeration.

As shown in a later-described comparative example, since a Henschel mixer which is a blade-type mill and is ordinarily used for the surface treatment of magnetic particles only has a stirring operation, use of a Henschel mixer does not produce the above-mentioned advantages of the present invention.

The magnetic particles (1) according to the present invention are obtained by kneading magnetic particles containing iron as the main component and having an isotropic shape and an average particle diameter of 0.1 to 1.0 μm with an organic compound having a hydrophobic group, kneading, smearing and spatula-stroking the magnetic particles and the organic compound by a wheel-type mill or an attrition mill so as to coat the surfaces of the magnetic particles containing iron as the main component with the organic compound having a hydrophobic group.

The magnetic particles (2) according to the present invention are obtained by kneading, smearing and spatula-stroking magnetic particles containing iron as the main component which have an acicular or spindle shape, an average major axial diameter of 0.1 to 3.0 μm and an axial ratio (major axial diameter/minor axial diameter) of not more than 3 by a wheel-type mill or an attrition mill so as to release from the agglomeration of the particles.

The magnetic particles (3) according to the present invention are obtained by kneading magnetic particles containing iron as the main ingredient and having an acicular or spindle shape, and average major axial diameter of 0.1 to 3.0 μm and an axial ratio (major axial diameter/minor axial diameter) of not more than 10 with an organic compound having a hydrophobic group, kneading, smearing and spatule-stroking the magnetic particles and the organic compound by a wheel-type mill or an attrition mill so as to coat the surfaces of the magnetic particles containing iron as the main component with the organic compound having a hydrophobic group.

As magnetic particles containing iron as the main component, magnetite particles, maghemite particles, magnetite and maghemite particles containing elements other than Fe such as zinc and manganese, and spinel-type ferrite particles containing at least one selected from the group consisting of zinc, manganese and nickel may be exemplified.

If magnetic particles containing iron as the main component have an average particle diameter of less than 0.1 μm, the magnetic agglomeration of the magnetic particles becomes so large as to make the dispersion of the magnetic particles in a resin difficult. On the other hand, if the average particle diameter exceeds 3.0 μm, the distribution of the magnetic particles in a resin becomes nonuniform, so that these magnetic particles are unfavorable as magnetic particles of a magnetic toner.

In case of the magnetic particles (1) according to the present invention, from the view point of the dispersibility and uniform distribution of the magnetic particles in a resin, the average particle diameter of 0.1 to 0.5 μm is preferable. "Particles having an isotropic shape" means particles in which the ratio of the major axial diameter and the minor axial diameter is not more than 1.5, preferably 1.0 to 1.3, and include not only spherical, hexahedral and octahedral particles but also particles having no definite shapes.

In case of the magnetic particles (2) according to the present invention, from the view point of the dispersibility and uniform distribution of the magnetic particles in a resin, an average major axial diameter of 0.1 to 1.0 μm and an axial ratio (major axial diameter/ minor axial diameter) of 1.5 to 2.5 are preferred. "Particles having an acicular or spindle shape" include not only acicular and spindle particles but also rise-type and spheroidal particles.

In case of the magnetic particles (3) according to the present invention, from the view point of the dispersibility and uniform distribution of the magnetic particles in a resin, an average major axial diameter of 0.1 to 1.0 μm and an axial ratio (major axial diameter/ minor axial diameter) of not more than 8, more preferable 1.5 to 7.0 are preferred. "Particles having an acicular or spindle shape" include not only acicular and spindle particles but also rise-type and spheroidal particles.

As an organic compound having a hydrophobic group in the present invention, titanate or silane coupling agent or a general-purpose surfactant or the like is used.

As the titanate coupling agent having a hydrophobic group, isopropyl triisostearoyl titanate, isopropyl tridodecylbenzenesulfonyl titanate, isopropyl tris(dioctylpyrophosphate) titanate, bis(dioctylpyrophosphate) oxyacetate titanate, bis(dioctylpyrophosphate) ethylene titanate and the like are usable. As the silane coupling agent having a hydrophobic group, 3-methacryloxypropyl trimethoxysilane, 3-chloropropyl trimethoxysilane and the like are usable.

As the general-purpose surfactant, known phosphate anionic surfactants, fatty ester nonionic surfactants and natural fats and oils derivatives such as alkyl amine and the like are usable.

The amount of organic compound having a hydrophobic group added is 0.1 to 10.0 parts by weight, preferably 0.1 to 5 parts by weight, more preferably 0.3 to 5 parts by weight based on 100 parts by weight of magnetic particles.

If it is less than 0.1 part by weight, the magnetic particles may be made unsufficiently hydrophobic.

If it exceeds 10.0 parts by weight, since the components which do not contribute to the magnetic properties increase, the saturization magnetization of the magnetic particles is reduced, so that the magnetic particles become unfavorable as magnetic particles for a magnetic toner.

In the present invention, a wheel-type mill or an attrition mill is used. As the wheel-type mill, a Simpson mix muller, multiple mill, Stotz mill, back-flow mill and Eirich mill. However, a wet pan mill, melanger and whirl mix, which have only the kneading and spatula-stroking operations but do not have a smearing operation, are not applicable.

Magnetic toner according to the present invention comprises the magnetic particles and a vinyl aromatic resin, and acrylic resin, or a copolymer of monomers thereof. As the vinyl aromatic resin, styrene resin and vinyl toluene resin may be exemplified. As the acrylic resin, acrylic resin and metharylic resin may be exemplified. As the copolymer, stylene-acrylic resin may be exemplified. In the magnetic toner, the content of the magnetic particles according to the present invention is 20 to 50 wt %.

Since the magnetic particles containing iron as the main component according to the present invention have an average particle diameter of 0.1 to 3.0 μm, a saturation magnetization of not less than 70 emu/g, and a liquid absorption of not more than 18 ml , they have a good affinity for a resin, in particular, a vinyl aromatic resin, an acrylic resin and a copolymer of mononers thereof which are generally used for a magnetic toner, and an excellent mixing property with these resins for a magnetic toner. Thus, the magnetic particles according to the present invention are suitable as magnetic particles for a magnetic toner.

EXAMPLES

The present invention will now be explained with reference to the following examples and comparative example. It is to be understood, however, that the present invention is not restricted by these examples.

The shapes of the particles in the examples and comparative examples were observed by a transmission electron microscope and a scanning electron microscope.

The magnetic characteristics of the magnetic particles were measured by using an vibrating sample magnetometer VSM-3S-15 (produced by Toei Kogyo K.K.) applying an external magnetic field of 10 KOe.

The gloss of the surface of a resin molding was expressed by the values measured at incident angles of 20° and 60° by using a digital glossmeter UGV-50 (produced by Suga Shikenki K.K.).

EXAMPLE 1

10 Kg of spherical magnetite particles having an average particle diameter of 0.23 μm, a saturation magnetization of 84.3 emu/g and a coercive force of 52 Oe and 100 g of a silane coupling agent KBM-6000 (produced by Shin-etsu Chemical Industry Co., Ltd) were charged in a Simpson mix muller (produced by Matsumoto Chuzo Co., Ltd.). By one-hour operation of the muller, the surfaces of the spherical magnetite particles were coated with the silane coupling agent.

The thus-obtained spherical magnetite particles coated with the silane coupling agent had a liquid absorption of 6.8 ml , and a saturation magnetization and a coercive force thereof were approximately equal to the respective value before treatment.

15 g of the spherical magnetite particles coated with the silane coupling agent and 35 g of a styreneacrylic resin Hymer TB-1000 (produced by Sanyo Kasei Co., Ltd.) which had been dried at a temperature of 60° C. were mulled at a surface temperature of 130° C. for 5 minutes by a hot roll.

The mulled product obtained was pressed into a sheet by a hot press to produce a sheet-like resin molding.

The gloss of the sheet-like resin molding was 96.4% at an incident angle of 60° and 92.0% at an incident angle of 20°.

Examples 2 to 5, Comparative Examples 1 to 2

Treated magnetic particles were obtained in the same way as in Example 1 except for varying the kinds of magnetic particles which were treated, the kinds and the amount of organic compound having a hydrophobic group and the kinds and the operation time of the machine.

The main producing conditions and the properties of the treated magnetic particles are shown in Table 1.

Reference Examples 1 to 3

The liquid absorptions and the gloss of the typical articles commercially available as magnetic particles for a magnetic toner were measured in accordance with the present invention. The results are shown in Table 2. All of these magnetic particles have a large liquid absorption and a small affinity for a resin.

Example 6

10 Kg of acicular magnetite particles having an average major axial diameter of 0.25 μm, an axial ratio (major axial diameter/minor axial diameter) of 2.2, a saturation magnetization of 85.0 emu/g and a coercive force of 236 Oe were charged into Simpson mix muller (produced by Matsumoto Chuzo Co., Ltd.). By 0.5 hour operation of the muller, the acicular magnetite particles were treated.

The thus-obtained acicular magnetite particles had a liquid absorption of 14.0 ml, and a saturation magnetization and a coercive force thereof were approximately equal to the respective value before treatment.

15 g of the obtained acicular magnetite particles and 35 g of a styrene-acrylic resin Hymer TB-1000 (produced by Sanyo Kasei Co., Ltd.) which had been dried at a temperature of 60° C. were mulled at a surface temperature of 130° C. for 5 minutes by a hot roll.

The mulled product obtained was pressed into a sheet by a hot press to produce a sheet-like resin molding.

The gloss of the sheet-like resin molding was 99.2% at an incident angle 60° and 90.8% at an incident angle 20°.

Examples 7 to 9 and Comparative Examples 3 to 4

Treated magnetic particles were obtained in the same way as in Example 6 except for varying the kinds of magnetic particles which were treated, the kinds and the operation time of the machine.

The main producing conditions and the properties of the treated magnetic particles are shown in Table 3.

Example 10

10 Kg of acicular magnetite particles having an average major axial diameter of 0.5 μm, an axial ratio (major axial diameter/minor axial diameter) of 7, a saturation magnetization of 84.2 emu/g and a coercive force of 349 Oe and 30 g of titanate coupling agent Plenact TTS (produced by Ajinomoto Co., Ltd.) were charged into a Shimpson mix muller (produced by Matsumoto Chuzo Co., Ltd.). By one-hour operation of the muller, the surfaces of the acicular magnetite particles were coated with the titanate coupling agent.

The thus-obtained acicular magnetite particles coated with the titanate coupling agent had a liquid absorption of 17.5 ml , and a saturation magnetization and a coercive force thereof were approximately equal to the respective value before treatment.

15 g of the acicular magnetite particles coated with the titanate coupling agent and 356 g of a styrene-acrylic resin Hymer TB-1000 (produced by Sanyo Kasei Co., Ltd.) which had been dried at a temperature of 60° C. were mulled at a surface temperature of 130° C. for 5 minutes by a hot roll.

The mulled product obtained was pressed into a sheet by a hot-press to produce a sheet-like resin molding.

The gloss of the sheet-like resin molding was 101.5% at an incident angle of 60° and 91.1% at an incident angle of 20°.

Example 11 to 16, Comparative Examples 5 to 7

Treated magnetite particles were obtained in the same way as in Example 10 except for varying the kinds of magnetic particles which were treated, the kind and the amount of organic compound having a hydrophobic group and the kind and operation time of the machine.

The main producing conditions and the properties of the treated magnetic particles are shown in Table 4.

Reference Examples 4 to 5

The liquid absorptions and gloss of the typical articles commercially available as magnetic particles for a magnetic toner were measured in accordance with the present invention, the results are shown in Table 5. All of these magnetic particles have a large liquid absorption and a small affinity for a resin.

TABLE 1

| Examples & Comparative Examples | Magnetic Particles being treated: Kinds | Shape | Average Particle Diameter (μm) | Saturation Magnetization (emu/g) | Coercive Force (Oe) | Organic Compound having Hydrophobic Group: Kinds | Amount (g) |
|---|---|---|---|---|---|---|---|
| Example | | | | | | | |
| 1 | Magnetite Particles | Spherical | 0.23 | 84.3 | 52 | Silane Coupling Agent KBM-6000 (Produced by Shinetsu Chemical Industry Co., Ltd.) | 100 |
| 2 | Magnetite Particles | Spherical | 0.23 | 84.2 | 53 | Titanate Coupling Agent Plenact TTS (Produced by Ajinomoto Co., Ltd.) | 100 |
| 3 | Magnetite Particles | Spherical | 0.23 | 83.5 | 52 | Natural Fats and Oil Derivative type Surfactant Amine 0 (Produced by Lion Corp.) | 100 |
| 4 | Magnetite Particles | Spherical | 0.23 | 82.5 | 52 | Titanate Coupling Agent Plenact TTS (Produced by Ajinomoto Co., Ltd.) | 400 |
| 5 | Magnetite Particles | Octahedral | 0.28 | 84.0 | 110 | Titanate Coupling Agent Flenact TTS (Produced by Ajinomoto Co., Ltd.) | 100 |
| Comparative Example | | | | | | | |
| 1 | Magnetite Particles | Spherical | 0.23 | 85.0 | 53 | — | — |
| 2 | Magnetite Particles | Spherical | 0.23 | 82.1 | 56 | Titanate Coupling Agent Plenact TTS (Produced by Ajinomoto Co., Ltd.) | 400 |

| Examples & Comparative Examples | Machine: Kinds | Operation Time (hrs) | Treated Magnetic Particles: Liquid Absorption (ml) | Gloss of Resin Molding: Incident Angle 60° (%) | Incident Angle 20° (%) |
|---|---|---|---|---|---|
| Example | | | | | |
| 1 | Simpson Mix Muller MPUV-2 (Produced by Matsumoto Chuzo Co., Ltd. | 1 | 6.8 | 96.4 | 92.0 |
| 2 | Simpson Mix Muller MPUV-2 (Produced by Matsumoto Chuzo Co., Ltd. | 1 | 6.5 | 96.7 | 93.0 |
| 3 | Simpson Mix Muller MPUV-2 (Produced by Matsumoto Chuzo Co., Ltd. | 1 | 6.9 | 98.0 | 93.8 |
| 4 | Simpson Mix Muller MPUV-2 (Produced by Matsumoto Chuzo Co., Ltd. | 1 | 5.5 | 98.5 | 94.0 |
| 5 | Simpson Mix Muller MPUV-2 (Produced by Matsumoto Chuzo Co., Ltd. | 1 | 8.5 | 94.5 | 91.3 |
| Comparative Example | | | | | |
| 1 | Simpson Mix Muller MPUV-2 (Produced by Matsumoto Chuzo Co., Ltd. | 1 | 20.4 | 96.0 | 83.0 |
| 2 | Henschel Mixer 10B (Produced by Mitsui Miike Machinery | 1 | 10.5 | 96.5 | 88.5 |

TABLE 1-continued

| | |
|---|---|
| | Co., Ltd.) |

TABLE 2

| Reference Examples | Magnetic Particles: Kinds | Average Particle Diameter (μm) | Saturation Magnetization (emu/g) | Coercive Force (Oe) | Liquid Absorption (ml) | Gloss of Resin Molding: Incident Angle 60° (%) | Incident Angle 20° (%) |
|---|---|---|---|---|---|---|---|
| Reference Example | | | | | | | |
| 1 | Mapico Black-13 (Columbia Chemical Corp.) | 0.25 | 81.5 | 118 | 18.5 | 93.4 | 81.3 |
| 2 | BL-100 (Titan Industries Co., Ltd.) | 0.25 | 88.6 | 81 | 15.7 | 96.1 | 83.2 |
| 3 | BK-5099 (Pfizer Corp.) | 0.25 | 83.5 | 110 | 18.2 | 90.0 | 83.3 |

TABLE 3

| Examples & Comparative Example | Magnetic Particles being treated: Kinds | Shape | Average Major Axial Diameter (μm) | Axial Ratio | Saturation Magnetization (emu/g) | Coercive Force (Oe) |
|---|---|---|---|---|---|---|
| Example | | | | | | |
| 6 | Magnetite Particles | Spindle | 0.25 | 2.2 | 85.0 | 236 |
| 7 | Magnetite Particles | Spindle | 0.5 | 2.2 | 85.2 | 210 |
| 8 | Magnetite Particles | Spindle | 0.25 | 1.5 | 86.0 | 180 |
| 9 | Magnetite Particles | Spindle | 0.5 | 1.6 | 86.3 | 170 |
| Comparative Example | | | | | | |
| 3 | Magnetite Particles | Spindle | 0.25 | 2.2 | 85.1 | 241 |
| 4 | Magnetite Particles | Acicular | 0.5 | 7 | 84.8 | 355 |

| Examples & Comparative Examples | Machine: Kinds | Operation Time (hrs) | Treated Magnetic Particles: Liquid Absorption (ml) | Gloss of Resin Molding: Incident Angle 60° (%) | Incident Angle 20° (%) |
|---|---|---|---|---|---|
| Example | | | | | |
| 6 | Simpson Mix Muller MPUV-2 (Produced by Matsumoto Chuzo Co., Ltd.) | 0.5 | 14.0 | 99.2 | 90.8 |
| 7 | Simpson Mix Muller MPUV-2 (Produced by Matsumoto Chuzo Co., Ltd.) | 0.5 | 13.5 | 102.0 | 91.0 |
| 8 | Simpson Mix Muller MPUV-2 (Produced by Matsumoto Chuzo Co., Ltd.) | 0.5 | 13.0 | 101.5 | 92.0 |
| 9 | Simpson Mix Muller MPUV-2 (Produced by Matsumoto Chuzo Co., Ltd.) | 0.5 | 12.1 | 103.5 | 92.5 |
| Comparative Example | | | | | |
| 3 | Pulverizer Sample Mill K-II-1 (Produced by Fuji Denki KogyoKabushiki | — | 30.0 | 95.0 | 85.1 |

TABLE 3-continued

| | | | | | |
|---|---|---|---|---|---|
| 4 | Kaisha) Pulverizer Sample Mill K-II-1 (Produced by Fuji Denki KogyoKabushiki Kaisha) | — | 35.0 | 90.0 | 80.0 |

TABLE 4

| Examples & Comparative Examples | Magnetic Particles being treated | | | | | | Organic Compound having Hydrophobic Group | |
|---|---|---|---|---|---|---|---|---|
| | Kinds | Shape | Average Major Axial Diameter (μm) | Axial Ratio | Saturation Magnetization (emu/g) | Coercive Force (Oe) | Kinds | Amount (g) |
| Example | | | | | | | | |
| 10 | Magnetite Particles | Acicular | 0.5 | 7 | 84.2 | 349 | Titanate Coupling Agent Plenact TTS (Produced by Ajinomoto Co., Ltd.) | 30 |
| 11 | Magnetite Particles | Acicular | 0.5 | 7 | 84.2 | 349 | Titanate Coupling Agent Plenact TTS (Produced by Ajinomoto Co., Ltd.) | 100 |
| 12 | Magnetite Particles | Acicular | 0.5 | 7 | 84.2 | 349 | Titanate Coupling Agent Plenact TTS (Produced by Ajinomoto Co., Ltd.) | 300 |
| 13 | Magnetite Particles | Acicular | 0.5 | 4 | 88.2 | 286 | Titanate Coupling Agent Plenact TTS (Produced by Ajinomoto Co., Ltd.) | 100 |
| 14 | Magnetite Particles | Acicular | 0.5 | 7 | 84.2 | 349 | Silane Coupling Agent A-187 (Produced by Japane Yunika Co., Ltd.) | 100 |
| 15 | Magnetite Particles | Acicular | 0.5 | 7 | 84.2 | 349 | Titanate Coupling Agent 338K (Produced by Ajinomoto Co., Ltd.) | 100 |
| 16 | Magnetite Particles | Spindle | 0.25 | 2.2 | 85.5 | 240 | Titanate Coupling Agent Plenact TTS (Produced by Ajinomoto Co., Ltd.) | 100 |
| Comparative Example | | | | | | | | |
| 5 | Magnetite Particles | Acicular | 0.5 | 4 | 84.2 | 349 | Titanate Coupling Agent Plenact TTS (Produced by Ajinomoto Co., Ltd.) | 100 |
| 6 | Magnetite Particles | Acicular | 0.5 | 4 | 84.2 | 349 | Silane Coupling Agent A-187 (Produced by Japane Yunika Co., Ltd.) | 100 |
| 7 | Magnetite Particles | Spindle | 0.25 | 2.2 | 85.5 | 240 | Titanate Coupling Agent Plenact TTS (Produced by Ajinomoto Co., Ltd.) | 100 |

| Examples & Comparative Examples | Machine | | Treated Magnetic Particles | | |
|---|---|---|---|---|---|
| | | | | Gloss of Resin Molding | |
| | Kinds | Operation Time (hrs) | Liquid Absorption (ml) | Incident Angle 60° (%) | Incident Angle 20° (%) |
| Example | | | | | |
| 10 | Simpson Mix Muller MPUV-2 (Produced by Matsumoto Chuzo Co., Ltd. | 1.0 | 17.5 | 101.5 | 91.1 |
| 11 | Simpson Mix Muller MPUV-2 (Produced by Matsumoto Chuzo Co., Ltd. | 1.0 | 15.0 | 104.2 | 92.0 |
| 12 | Simpson Mix Muller MPUV-2 (Produced by | 1.0 | 13.0 | 106.2 | 94.0 |

TABLE 4-continued

| | | | | | |
|---|---|---|---|---|---|
| | Matsumoto Chuzo Co., Ltd. | | | | |
| 13 | Simpson Mix Muller MPUV-2 (Produced by Matsumoto Chuzo Co., Ltd. | 1.0 | 13.0 | 105.5 | 93.0 |
| 14 | Simpson Mix Muller MPUV-2 (Produced by Matsumoto Chuzo Co., Ltd. | 1.0 | 14.8 | 106.0 | 92.6 |
| 15 | Simpson Mix Muller MPUV-2 (Produced by Matsumoto Chuzo Co., Ltd. | 1.0 | 14.8 | 103.5 | 91.8 |
| 16 | Simpson Mix Muller MPUV-2 (Produced by Matsumoto Chuzo Co., Ltd. | 1.0 | 10.0 | 107.0 | 95.0 |
| Comparative Example | | | | | |
| 5 | Henschel Mixer 10B (Produced by Mitsui Miike Machinery Co., Ltd.) | 1.0 | 30.0 | 100.0 | 86.5 |
| 6 | Henschel Mixer 10B (Produced by Mitsui Miike Machinery Co., Ltd.) | 1.0 | 33.0 | 101.2 | 87.7 |
| 7 | Henschel Mixer 10B (Produced by Mitsui Miike Machinery Co., Ltd.) | 1.0 | 25.0 | 101.0 | 88.5 |

TABLE 5

| | Magnetic Particles | | | | | | | Gloss of Resin Molding | |
|---|---|---|---|---|---|---|---|---|---|
| Reference Examples | Kinds | Average Major Axial Diameter (μm) | Axial Ratio (μm) | Saturation Magnetization (emu/g) | Coercive Force (Oe) | Liquid Absorption (ml) | | Incident Angle 60° (%) | Incident Angle 20° (%) |
| Reference Example | | | | | | | | | |
| 4 | SP-BLACK (Produced by Titan Industries Co., Ltd.) | 0.7 | 6 | 84.8 | 363 | 34.0 | | 88.6 | 77.5 |
| 5 | MTA-740 (Produced by Toda Corporation) | 0.5 | 7 | 85.1 | 358 | 20.5 | | 95.3 | 84.5 |

What is claimed is:

1. Magnetic particles containing iron as the main component which have an isotropic shape, an average particle diameter of 0.1 to 1.0 μm, are coated with an organic compound having a hydrophobic group and have a liquid absorption of not more than 10 ml as measured by a following method wherein, (1) a styrene-acrylic resin and xylene are mixed at the resin content: (resin)/ resin+xylene×100 of 20 wt %, in a polyester container provided with a cover by using a paint conditioner, thereby obtaining a resin solution;

(2) 10 g of magnetic particles containing iron as the main component which are weighed out by an electronic balance are charged in a 100-ml polyester container, to which 50 ml of said resin solution prepared are added dropwise by using a burette and the resultant mixture is stirred with a glass rod;

(3) a point at which a first droplet naturally drops from the end of said glass rod as a result of the obtained phase in said polyester container becoming uniform and the fluidity thereof being increased is regarded as the end point; and (4) the amount of resin solution used until said end point is measured as said liquid absorption;

said organic compound having a hydrophobic group being a titanate coupling agent, a silane coupling agent or a general-purpose surfactant, a surface of a resin molding containing acid magnetic particles having a gloss of not less than 90% when measured at an incident angle of 20°.

2. Magnetic particles according to claim 1, which further have an axial ratio (major axial diameter/minor axial diameter) of not more than 1.5.

3. Magnetic particles according to claim 1, wherein said titanate coupling agent is selected from the group consisting of isopropyl triisostearoyl titante, isopropyl tridodecylbenzenesulfonyl titanate, isopropyl tridodecylbenzenesulfonyl titanate, isopropyl tris(dioctylpyrophosphate) titanate, bis(dioctylpyrophosphate) oxyacetate titanate and bis(dioctylpyrophosphate) ethylene titanate.

4. Magnetic particles according to claim 1, wherein said silane coupling agent is selected from the group consisting of 3-methacryloxypropyl trimethoxysilane and 3-chloropropyl trimethoxysilane.

5. Magnetic particles according to claim 1, wherein said general-purpose surfactant is selected from the group consisting of phosphate anionic surfactants, fatty ester nonionic surfactants, derivatives of natural fats and derivatives of natural oils.

6. Magnetic particles according to claim 1, wherein the amount of said organic compound having a hydrophobic group is 0.1 to 10 parts by weight based on 100 parts by weight of the core magnetic particles.

7. A magnetic toner comprising the magnetic particles defined as claim 1 and a vinyl aromatic resin, an acrylic resin or a copolymer of monomers thereof.

8. A magnetic toner according to claim 7, wherein the content of said magnetic particles is 20 to 50% by weight.

9. Magnetic particles containing iron as the main component which have an acicular or spindle shape, an average major axial diameter of 0.1 to 3.0 μm, an axial ratio (major axial diameter/minor axial diameter) of not more than 3 and a liquid absorption of not more than 18 ml as measured in the method wherein:

(1) a styrene-acrylic resin and xylene are mixed at the resin content: (resin)/ resin+xylene)×100 of 20 wt %, in a polyester container provided with a cover by using a paint conditioner, thereby obtaining a resin solution;

(2) 10 g of magnetic particles containing iron as the main component which are weighed out by an electronic balance are charged in a 100-ml polyester container, to which 50 ml of said resin solution prepared are added dropwise by using a burette and the resultant mixture is stirred with a glass rod;

(3) a point at which a first droplet naturally drops from the end of said glass rod as a result of the obtained paste in said polyester container becoming uniform and the fluidity thereof being increased is regarded as the end point; and (4) the amount of resin solution used until said end point is measured as said liquid absorption, a surface of a resin molding containing said magnetic particles having a gloss of not less than 90% when measured at an incident angle of 20°.

10. Magnetic particles according to claim 9, wherein said axial ratio (major axial diameter/minor axial diameter) is 1.5 to 2.5.

11. A magnetic toner comprising the magnetic particles defined as claim 9 and a vinyl aromatic resin, an acrylic resin or a copolymer of monomers thereof.

12. A magnetic toner according to claim 11, wherein the content of said magnetic particles is 20 to 50% by weight.

13. Magnetic particles containing iron as the main component which have an acicular or spindle shape, an average major axial diameter of 0.1 to 3.0 μm, an axial ratio (major axial diameter/minor axial diameter) of not more than 10, are coated with an organic compound having a hydrophobic group and have a liquid absorption of not more than 18 ml as measured in the following method wherein:

(1) a styrene-acrylic resin and xylene are mixed at the resin content: (resin)/(resin+xylene)×100 of 20 wt %, in a polyester container provided with a cover by using a paint conditioner, thereby obtaining a resin solution;

(2) 10 g of magnetic particles containing iron as the main component which are weighed out by an electronic balance are charged in a 100-ml polyester container, to which 50 ml of said resin solution prepared are added dropwise by using a burette and the resultant mixture is stirred with a glass rod;

(3) a point at which a first droplet naturally drops from the end of said glass rod as a result of the obtained paste in said polyester container becoming uniform and the fluidity thereof being increased is regarded as the end point; and (4) the amount of resin solution used until said end point is measured as said liquid absorption;

said organic compound having a hydrophobic groups being a titanate coupling agent, a silane coupling agent or a general purpose surfactant, a surface of a resin molding containing said magnetic particles having a gloss of not less than 90% when measured at an incident angle of 20°.

14. Magnetic particles according to claim 13, wherein said axial ratio (major axial diameter/minor axial diameter) is 1.5 to 8.

15. Magnetic particles according to claim 13, wherein said titanate coupling agent is selected from the group consisting of isopropyl triisostearoyl titanate, isopropyl tridodecylbenzenesulfonyl titanate, isopropyl tirs(dioctylpyrophosphate) titanate, bis(dioctylpyrophosphate) oxyacetate titanate and bis(dioctylpyrophosphate) ethylene titanate.

16. Magnetic particles according to claim 13, wherein said silane coupling agent is selected from the group consisting of 3-methacryloxypropyl trimethoxysilane and 3-chloropropyl trimethoxysilane.

17. Magnetic particles according to claim 13, wherein said general-purpose surfactant is selected from the group consisting of phosphate anionic surfactants, fatty ester nonionic surfactants, derivatives of natural fats and derivatives of natural oils.

18. Magnetic particles according to claim 13, wherein the amount of said organic compound having a hydrophobic group is 0.1 to 10 parts by weight based on 100 parts by weight of the core magnetic particles.

19. A magnetic toner comprising the magnetic particles defined as claim 13 and a vinyl aromatic resin, an acrylic resin or a copolymer of monomers thereof.

20. A magnetic toner according to claim 19, wherein the content of said magnetic particle is 20 to 50% by weight.

* * * * *